US011134765B2

(12) United States Patent
Ben-David et al.

(10) Patent No.: US 11,134,765 B2
(45) Date of Patent: Oct. 5, 2021

(54) VARIABLE DIAMETER ADJUSTABLE HAIR TOOL

(71) Applicant: Sutra Beauty Inc., Van Nuys, CA (US)

(72) Inventors: Liam Ben-David, Woodland Hills, CA (US); Deng Zhiyong, Dongguan (CN)

(73) Assignee: Sutra Beauty, Inc., Los Angeles, CA (US)

( * ) Notice: Subject to any disclaimer, the term of this patent is extended or adjusted under 35 U.S.C. 154(b) by 127 days.

(21) Appl. No.: 16/184,189

(22) Filed: Nov. 8, 2018

(65) Prior Publication Data

US 2020/0146414 A1 May 14, 2020

(51) Int. Cl.
*A45D 20/08* (2006.01)
*A45D 2/36* (2006.01)

(52) U.S. Cl.
CPC ..... *A45D 2/367* (2013.01)

(58) Field of Classification Search
CPC . A45D 1/02; A45D 1/04; A45D 2/367; A45D 2/06; A45D 2/146; A45D 2/2407; A45D 2/2464; A45D 2/36; A45D 2/00; A45D 1/00; A45D 1/16; A45D 6/00
USPC ..... 132/265, 226, 237, 238, 229, 232, 269, 132/271, 231, 245–262, 239
See application file for complete search history.

(56) References Cited

U.S. PATENT DOCUMENTS 4,260,871 A * 4/1981 Nagelkerke ..... A45D 4/16 132/229
RE30,866 E * 2/1982 Barradas ..... A45D 1/04 132/227
4,456,020 A * 6/1984 van Deursen ..... A45D 2/24 132/237
4,856,542 A * 8/1989 Hollenberg ..... A45D 2/24 132/265
5,000,200 A * 3/1991 Roberts ..... A45D 2/24 132/245
5,694,954 A * 12/1997 Habibi ..... A45D 2/14 132/211
6,014,977 A * 1/2000 Friedman ..... A45D 1/04 132/225
6,098,635 A * 8/2000 Marino ..... A46B 13/02 132/238
6,138,685 A * 10/2000 O'Brien ..... A45D 2/362 132/207
6,186,150 B1 * 2/2001 Lo ..... A45D 2/14 132/229

(Continued)

FOREIGN PATENT DOCUMENTS

DE 2528822 A1 * 1/1977 ..... A45D 2/36
DE 2529026 A1 * 5/1977 ..... A45D 2/36
WO WO-2004091335 A2 * 10/2004 ..... A45D 1/16

*Primary Examiner* — Rachel R Steitz
(74) *Attorney, Agent, or Firm* — Adam F. Lewental

(57) ABSTRACT

A variable diameter adjustable hair tool that includes a barrel with a number of plates. A heater included in the hair tool may transfer heat at a specified temperature to the plates. The heater may draw power from a power unit. The hair tool has a handle connected to the barrel that allows the user to hold the tool. The adjustable diameter is achieved by an actuator that alters the outer diameter of the barrel by changing the distance between a surface of the plates and a central axis of the barrel. The actuator may controlled by a control component that converts a user action into an action of the actuator. Other aspects are also described and claimed.

5 Claims, 4 Drawing Sheets

(56) References Cited

U.S. PATENT DOCUMENTS

| | | | | |
|---|---|---|---|---|
| 2008/0041406 | A1* | 2/2008 | Le | A45D 24/16<br>132/211 |
| 2008/0135537 | A1* | 6/2008 | Suber | A45D 1/04<br>219/225 |
| 2009/0293901 | A1* | 12/2009 | Chan | A45D 2/146<br>132/245 |
| 2010/0116286 | A1* | 5/2010 | O'Rourke | A45D 4/16<br>132/254 |
| 2011/0061673 | A1* | 3/2011 | Yahnker | A45D 1/10<br>132/232 |
| 2011/0203606 | A1* | 8/2011 | Recchion | A45D 1/04<br>132/269 |
| 2013/0152961 | A1* | 6/2013 | Sinnott | A45D 4/08<br>132/227 |
| 2013/0263883 | A1* | 10/2013 | Story | A45D 1/04<br>132/229 |
| 2015/0265024 | A1* | 9/2015 | Maclaine | A45D 20/50<br>132/271 |
| 2017/0273421 | A1* | 9/2017 | Heffer | A45D 1/00 |
| 2018/0055176 | A1* | 3/2018 | Wong | A45D 1/04 |

* cited by examiner

VARIABLE DIAMETER ADJUSTABLE HAIR TOOL

FIELD

An aspect of the disclosure here relates to a tool for curling hair. Other aspects are also described.

BACKGROUND

Hair tools may achieve various styling effects by applying heat to the hair. For instance, if the heat is applied when the hair is wrapped in a circular fashion, then curls may be produced. Different varieties of curling effects may be introduced by a hair tool that the hair is being wrapped around with one geometry than by a hair tool with a different geometry, and so it is often desirable for a user to own several different hair tools.

SUMMARY

Aspects of the present disclosure are directed to a hair tool that can provide similar benefits that may be provided by several different hair tool geometries within a single device. One aspect is a variable diameter adjustable hair tool that includes a barrel with a number of plates. A heater included in the hair tool may transfer heat at a specified temperature to the plates. The heater may draw power from a power unit. The hair tool has a handle connected to the barrel that allows the user to hold the tool. The adjustable diameter is achieved by an actuator that alters the outer diameter of the barrel by changing the distance between a surface of the plates and a central axis of the barrel. The actuator may controlled by a control component that converts a user action into an action of the actuator.

Another aspect discussed the barrel itself. The barrel of the hair tool may have more than one actuator, such that different parts of the barrel may have different diameters. This allows configurations of the barrel where the barrel may have a slope, such as a cone or inverted cone style barrel.

An aspect also considers a barrel with a mechanical actuator. The mechanical actuator may include a nozzle that by rotating, a user can control the diameter of the barrel.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Figure 1:
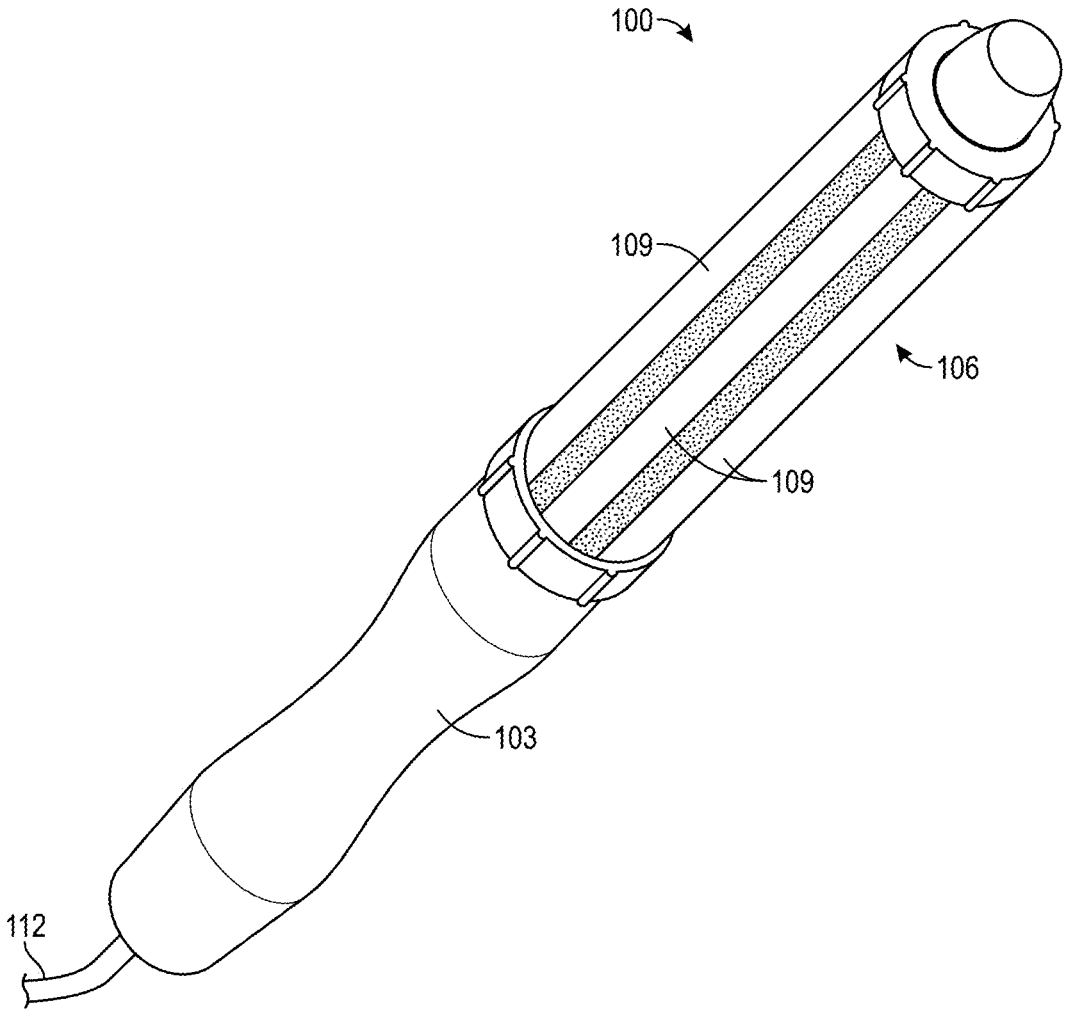
FIG. 1 shows an exemplary variable diameter adjustable hair tool.

FIG. 1 illustrates a hair tool 100. The hair tool 100 includes a heater (not shown), a barrel 106, a handle 103 and a means for altering the outer diameter of the barrel. The heater may generate heat by through an exothermic process, such as by electric heating or chemical heating. An electric heater may convert electric energy into heat energy. For example, the electric heater may draw power from a power source, such as a battery or an electrical grid via a converter and a power cord 112, and may pass the electricity through a heating element such as a resistor, which converts electricity into heat through a process known as Joule heating. In another example, a chemical heater may use a controlled ignition of a flammable substance, such as butane and methane, to convert the flammable substance into heat energy. In an aspect, the amount of heat generated by the heater may be selected by a user. For example, the heater may be connected to an adjustable dial with various heat settings, such as different possible temperatures.

In an aspect, the heater is thermally coupled to the barrel 106, such that heat energy produced by the heater may be conducted to an outer surface of the barrel 106. For example, the heater may be substantially enclosed by and in contact with the barrel 106, such that the heat produced by the heater passes outward to the barrel 106. In another example, the heater may be outside the barrel 106, such as located in the handle 103, and pass heat to the barrel 106 through a thermally conductive path.

The handle 103 may be connected to the barrel 106, such that a user may be able to hold the hair tool by the handle 103. The handle 103 may be substantially insulated from the heat. The handle 103 may be designed ergonomically, such that the handle 103 is of a length and shape that is comfortable for a user to hold during operation. For example, the handle 103 may be cylindrical with a diameter that allows an average person to hold. The handle 103 may be hollow, and thus capable of containing various components of the hair tool 100. In one example, the heater may be located within the handle 103. In another example, components necessary for the operation of the heater may be located within the handle 103, such as the power source for an electric heater or the chemicals for a chemical heater.

In an aspect, the means for altering the outer diameter of the barrel 106 may include a plurality of plates connected to an actuator. The plates may form an outer surface of the barrel 106 and the barrel 106 may be hollow, such that the barrel 106 may act as a housing for a thermal conduction path member that extends from the heater. In another aspect, the barrel 106 may house the heater. In a further aspect, the barrel may have a solid core that can serve many purposes, such as acting as an attachment point for the plates and actuators and for conducting heating. The plates may be made from any of known materials with thermally conductive properties, such as Teflon, ceramic, tourmaline, metal, or titanium. The barrel 106 may be substantially cylindrical, such that hair may be wrapped about the barrel 106 by a user. The barrel 106 may be capable of passing heat to hair that is in contact with or in close proximity to the barrel 106, such as by passing heat generated by a heater that has a thermally conductive path to barrel 106 to an outer surface of the barrel.

Each plate 109 may be a portion of the circumference of the outer surface of the barrel 106. The plate 109 may be the length of the barrel. The plate 109 may be rectangular. The plate 109 may have any geometry that allows for a substantially round barrel 106 circumference, such as, for example, a spiral configuration, such that each plate 109 of the plurality of plates wraps at an angle around the circumference of the barrel 106 from a first end of the barrel 106 to a second end of the barrel 106. The plate 109 may have a curvature in its width when viewed from a distal end of the barrel 106, such that several plates that are adjacent may combine to form the circumference of the barrel 106.

Figure 2A:
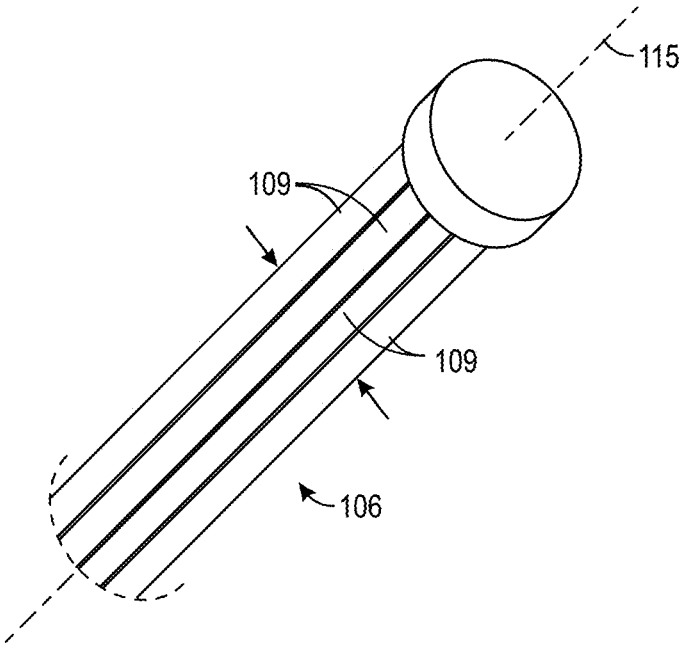
FIG. 2*a* shows an exemplary variable diameter adjustable hair tool in a narrow diameter setting.
Figure 2B:
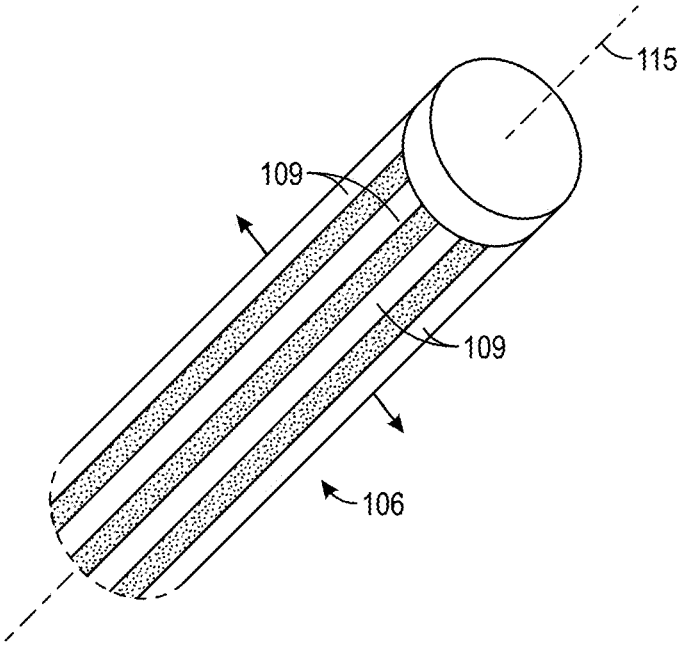
FIG. 2*b* shows an exemplary variable diameter adjustable hair tool in a wide diameter setting.

FIG. 2 shows an aspect where the actuator is connected to an end of the barrel 106 such that the actuator is able to change the diameter of the barrel 106. The actuator may be connected to a control component that can convert a user's action into an action of the actuator. The actuator may facilitate diameter adjustment of the barrel 106 by any of various methods. For example, FIG. 2*a* illustrates a segment of a hair tool 100 where each plate 109 of the barrel 106 may be connected to the actuator at an end. When the actuator moves in a first direction, such as toward the center point of the diameter 115 of the barrel 106, the plate 109 may be forced inward, bringing the plates closer together. FIG. 2*b* shows a segment of a hair tool 100 where the actuator moves in a second direction, such as away from the center point of the diameter 115 of the barrel 106. The plate 109 may be forced outward, bringing the plates farther apart. In one instance, a smallest diameter may be determined by when the plates are unable to move closer to the center point of the diameter 115 of the barrel 106, for example, by forming a substantially contiguous outer surface or hitting a preset limit. The largest diameter may be determined by when the plates have reached an outer limit allowed by the actuator. The barrel 106 may be designed to have a predetermined smallest diameter and largest diameter. For example, a ⅜ inch diameter barrel 106 may be desirable for some applications, yet a 2 inch diameter barrel 106 may be desirable for other applications. A barrel 106 configuration can be designed such that the barrel has a ⅜ inch diameter when at its smallest diameter and can be expanded to 2 inches when at its largest diameter. These sizes are given for illustrative purposes and are not limiting.

Figure 3A:
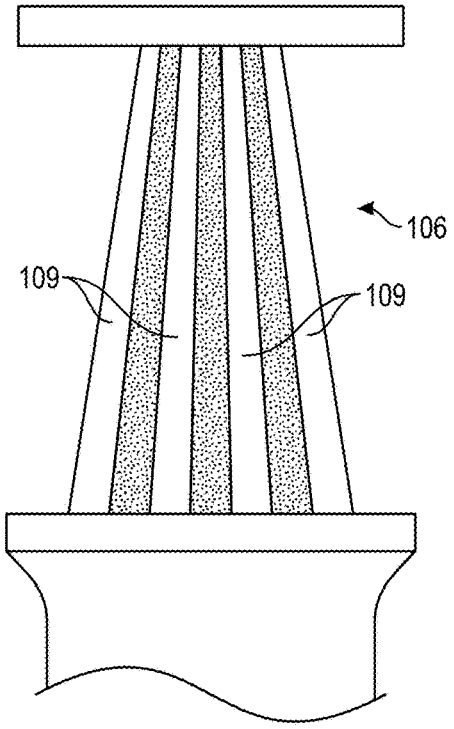
FIG. 3*a* shows an exemplary variable diameter adjustable hair tool in a cone setting.
Figure 3B:
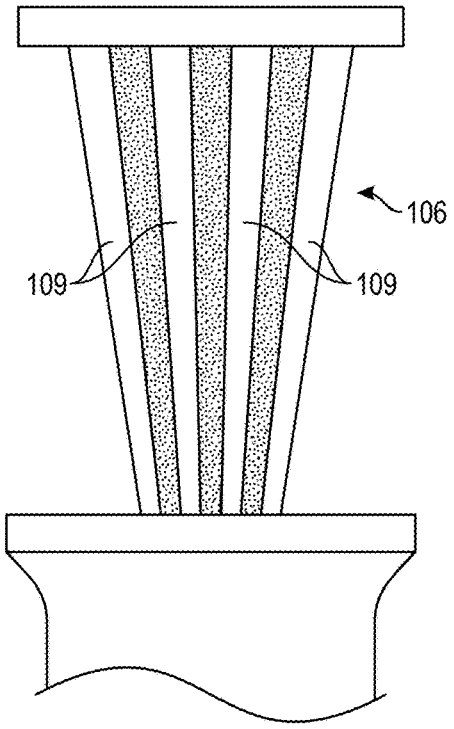
FIG. 3*b* shows an exemplary variable diameter adjustable hair tool in a inverted cone setting.

In an aspect shown by FIG. 3, the actuator could include a first actuator connected to a first end of the barrel and a second actuator connected to a second end of the barrel. When the first actuator is utilized, it may adjust the distance between the plates at the first end without affecting the distance between the plates at the second end, such that the second end is fixed. When the second actuator is utilized, it may adjust the distance between the plates at the second end without affecting the distance between the plates at the first end, such that the first end is fixed. In this way, the first actuator may be utilized to adjust the diameter at the first end of the barrel and the second actuator may be utilized to adjust the diameter at the second end of the barrel independently. Different barrel 106 end diameters produced by actuator adjustments at the first actuator and the second actuator can produce different barrel 106 configurations. For example, setting a first actuator to a wide diameter and a second actuator to a wide diameter can produce a wide diameter barrel 106. In another example, setting a first actuator to a narrow diameter and the second actuator to a wide diameter can produce a cone-style barrel, as shown in FIG. 3(*a*). In yet another example, setting a first actuator to a wide diameter and a second actuator to a narrow diameter can produce an inverted cone-style barrel, as shown in FIG. 3(*b*). In a different example, setting a first actuator to a narrow diameter and the second actuator to a narrow diameter can produce a narrow diameter barrel 106. The barrel 106 may be configured into any desired shape and diameter size that can be produced by using the first actuator to adjust the diameter of the first end of the barrel 106 to any point between and including the largest and smallest diameter of the first end and utilizing the second actuator to adjust the diameter of the second end of the barrel 106 to any point between and including the largest and smallest diameter of the second end.

Figure 4:
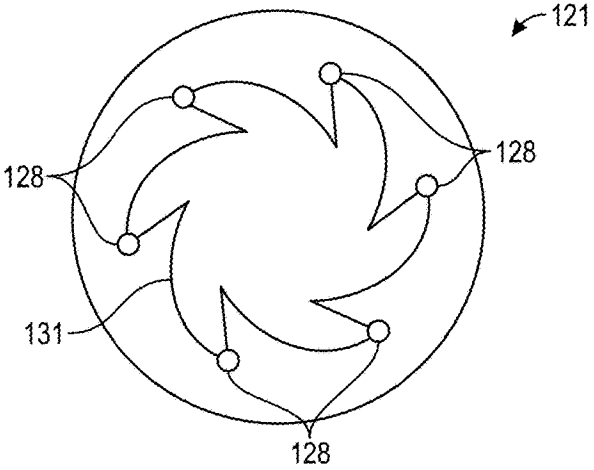
FIG. 4 shows an inside view of a nozzle for an exemplary viable diameter adjustable hair tool.
Figure 5:
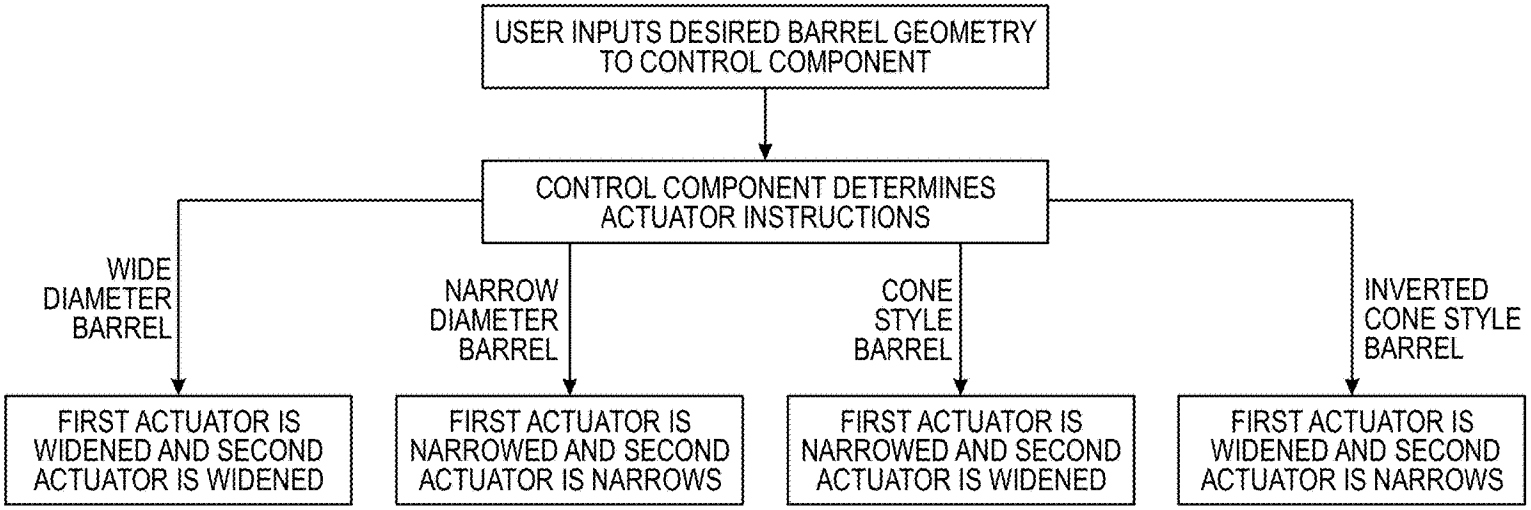
FIG. 5 shows an exemplary flowchart for a method for operating an adjustable variable diameter hair tool.

In an aspect, the actuator could be mechanical or electrical. A mechanical actuator could be connected to a mechanical control component. In an aspect, the mechanical control component may be a mechanical component capable of translating rotational movement to linear movement, such as a nozzle. The nozzle may be connected to an end of the barrel 106, such that the nozzle is connected to an end of each plate 109. When the nozzle is rotated in a first direction, the nozzle may increase the distance between the end of each plate 109 and the center point of the diameter 115 of the barrel 106 by any of several means. For instance, the nozzle may have an inner wall 121 that varies in radius from the center point of the diameter 115 at different points around the circumference of the nozzle. FIG. 4 shows the inside of a nozzle. The plates may be connected or in contact with the inner wall of the nozzle, such that when the nozzle is rotated, the plates may move, such as, for instance, by a roller 128 connected to an end of each plate 109. In another example, springs may press the plates into the inner wall 131 of the nozzle 121 to maintain contact. In another example, the plates may have a rail that is connected to a track on the inner wall 131. When the nozzle is rotated in a second direction, the nozzle may decrease the distance between the plate and the center point of the diameter 115 of the barrel.

In another example, an electrical actuator could be a motor. The motor may push or pull the plates to a desired distance from the center point of the diameter 115 of the barrel 106 to produce a desired barrel 106 diameter. For example, the motor could be connected to a switch that allows a user to set the diameter size. If the user wishes to set the barrel 106 to a desired diameter, the user may set the switch to the configuration that represents the desired diameter. The switch could be, and is not limited to, at least one of a dial and a set of buttons. In another instance, the switch may include options for at least one of preset barrel 106 styles and preset barrel 106 diameters. For example, there may be an option for an inverted cone barrel. When selected, the first actuator may adjust the diameter of the barrel 106 at the proximal end to the handle 103 to be narrower than the diameter of the barrel 106 at the distal end to the handle 103. The second actuator may adjust the diameter of the barrel 106 at the distal end to be wider than the diameter of the barrel 106 at the proximal end. In another example, there may be an option for a cone barrel. When selected, the second actuator may adjust the diameter of the barrel 106 at the distal end to be narrower than the diameter of the barrel 106 at the proximal end. The first actuator may adjust the diameter of the barrel 106 at the proximal end to be wider than the diameter of the barrel 106 at the distal end. In another example, there may be an option for a plurality of barrel 106 diameters, such as, but not limited to, ½ inch, 1 inch, 1½ inches, and 2 inches. When an option is selected, such as 1½ inches, the first actuator may adjust the diameter of the barrel 106 at the proximal end to be 1½ inches, and the second actuator may adjust the diameter of the barrel 106 at the distal end to be 1½ inches.

In some aspects, a controller may act as an intermediary for electrical components. For example, when a user changes an adjustable gauge controlling temperature, the adjustable gauge may send a signal to the controller, which sends a corresponding signal to the heater indicating that the heater should produce more or less heat, depending on the temperature that is selected in relation to the current temperature. In another example, if a user changes a switch controlling diameter size of the barrel 106, the switch may send a signal to the circuit board, which spends a corresponding signal to the actuator to increase the diameter of the barrel or decrease the diameter of the barrel, depending on the selected size relative to the current size.

An aspect is directed to a method for operating an adjustable variable diameter hair tool. A user determines what size and style barrel they require. The user then directs the control component to produce the desired barrel style. The control component directs the actuator to act on the plates of the barrel in a direction necessary to produce the desired barrel geometry. For example, a user may desire an inverted cone style barrel. The user may direct the control component to produce the inverted cone style barrel. The control component may direct the actuator at the proximal end to narrow the diameter of the barrel and the actuator at the distal end of the barrel widens the diameter of the barrel. In another example, the user may desire a cone style barrel. The user may direct the control component to produce the cone style barrel. The control component may direct the actuator at the distal end of the barrel to narrow the diameter of the barrel and the actuator at the proximal end of the barrel to widen the diameter of the barrel. In another example, the user may desire a wide diameter barrel. The user may direct the control component to produce the wide diameter barrel. The control component may direct the actuator at the proximal end to widen the diameter of the barrel and the actuator at the distal end of the barrel to widen the diameter of the barrel. In a further example, the user may desire a narrow diameter barrel. The user may direct the control component to produce the narrow diameter barrel. The control component may direct the actuator at the proximal end to narrow the diameter of the barrel and the actuator at the distal end of the barrel to narrow the diameter of the barrel.

Some aspects consider various attachments that may be included with the hair tool. For instance, the hair tool may have a clip for maintaining contact between the user hair and the barrel surface, such as a Marcel style clip. The hair tool may include a handhold that is on a distal end of the barrel that is insulated against heat.

While certain aspects have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. For example, while FIG. 1 depicts a device in which the plates of the barrel extend vertically from one end to the other, it is also possible to have plates that curve around the barrel. The description is thus to be regarded as illustrative instead of limiting.

What is claimed is:

1. A variable diameter adjustable hair tool, comprising:

a handle, a barrel connected to the handle on a distal end of the barrel, wherein the barrel comprises a plurality of plates, wherein each plate of the plurality of plates is rectangular in shape and each plate of the plurality of plates has a curvature such that the plurality of plates fit together in a cylindrical shape, a heater disposed within the barrel and connected by a thermally conductive path to the plurality of plates, a first actuator on the distal end of the barrel, wherein the first actuator is connected to each of the plurality of plates on a distal end of each of the plurality of plates and is disposed to push or pull the distal end of each of the plurality of plates to a desired distance from a central axis of the barrel, a second actuator on a proximal end of the barrel, wherein the second actuator is connected to each of the plurality of plates on a proximal end of each of the plurality of plates and is disposed to push or pull the proximal end of each of the plurality of plates to a desired distance from the central axis of the barrel, and the first actuator operates separately from the second actuator, and the second actuator operates separately from the first actuator, such that the first actuator independently adjusts a diameter of the distal end of the barrel, and the second actuator independently adjusts a diameter of the proximal end of the barrel.

2. The variable diameter adjustable hair tool of claim 1, wherein independent adjustment by an actuator comprises that a diameter of a first end of the barrel is changed by an actuator while a diameter of a second end of the barrel is fixed.

3. The variable diameter adjustable hair tool of claim 2, further comprising a first diameter at the distal end of the barrel and a second diameter at the proximal end of the barrel, wherein the first diameter and the second diameter are different.

4. The variable diameter adjustable hair tool of claim 3, wherein the first diameter is adjusted by the second actuator to be smaller than the second diameter, so as to produce an inverted cone-style barrel.

5. The variable diameter adjustable hair tool of claim 3, wherein the second diameter is adjusted by the second actuator to be smaller than the first diameter, so as to produce a cone-style barrel.

* * * * *